US007360589B2

(12) United States Patent
Moncus et al.

(10) Patent No.: US 7,360,589 B2
(45) Date of Patent: Apr. 22, 2008

(54) ARTICULATING BAIL ASSEMBLY AND METHOD

(75) Inventors: James Devin Moncus, Lafayette, LA (US); Joseph Hayden Miller, Jr., Lafayette, LA (US); Bryan Duhon, Church Point, LA (US)

(73) Assignee: Devin International, Inc., Lafayette, LA (US)

( * ) Notice: Subject to any disclaimer, the term of this patent is extended or adjusted under 35 U.S.C. 154(b) by 191 days.

(21) Appl. No.: 11/260,654

(22) Filed: Oct. 27, 2005

(65) Prior Publication Data

US 2007/0119035 A1 May 31, 2007

(51) Int. Cl.
*E21B 19/18* (2006.01)

(52) U.S. Cl. ..... 166/77.51; 166/77.1; 166/379

(58) Field of Classification Search ..... 166/77.1, 166/77.51, 379; 175/162, 220
See application file for complete search history.

(56) References Cited

U.S. PATENT DOCUMENTS 4,209,066 A * 6/1980 Watson ..... 166/377
6,966,385 B2 * 11/2005 Hemphill et al. ..... 166/380
7,077,209 B2 * 7/2006 McCulloch et al. ..... 166/379
2005/0189118 A1 * 9/2005 Moncus et al. ..... 166/381

* cited by examiner

*Primary Examiner*—Jennifer H. Gay
*Assistant Examiner*—Brad Harcourt
(74) *Attorney, Agent, or Firm*—C. Dean Domingue; Robert L. Waddell; Ted M. Anthony

(57) ABSTRACT

An apparatus for performing well intervention work on a rig. The apparatus comprises a first spreader that is operatively connected to a derrick, a pair of I-beams that have a distal end and a proximal end, and wherein the distal end of the pair of I-beams are connected to the first spreader. The apparatus further comprises a second spreader, and wherein the proximal end of the I-beams is connected to the second spreader. The apparatus further comprises a first pivot point on the first spreader and a second pivot point on the second spreader. In the most preferred embodiment, the apparatus further comprises a door, operatively attached to the second spreader, for allowing entry of the tubular. Also, the second spreader may include a shoulder for engagement with a tubular so that the tubular is supported by the second spreader so that the weight of the tubular can be transferred to the second spreader. A method of lifting a tubular used in well intervention work on a rig is also disclosed.

12 Claims, 6 Drawing Sheets

ARTICULATING BAIL ASSEMBLY AND METHOD

This invention relates to an apparatus used for well intervention work. More specifically, but not by way of limitation, this invention relates to an articulating bail assembly and method used on offshore platforms operatively associated with subterranean wells.

The search for hydrocarbons has led operators to explore and drill in remote and exotic areas of the globe. Deep water tracts have been explored and drilled with increasing frequency in recent years. Platforms set in waters of 1,000 to 2,000 feet has become common place, and in some instances, wells have been drilled in water depths of 5,000 feet. Different types of drilling and production platforms have been used in these deep waters. One type of platform is a tension leg platform (TLP). In the TLP, a floating platform is connected to the ocean floor via tendons such as steel cables, as is well understood by those of ordinary skill in the art. Another type of structure used in deep water is the spar platform which generally is a floating cylindrical structure that is anchored to the ocean floor with steel cable means. Other types of floating platforms are known in the art. In deep water, a fixed leg type platform is generally not an option due to the extreme water depths.

In the deep water drilling of subterranean reservoirs, drillers encounter numerous operational problems. For instance, wave conditions may cause a cyclic buoyant force based on the raising, lowering, heaving and pitching of the platform. Also, tidal conditions may cause a variation in platform height and cause similar buoyant forces. The applied forces will in turn cause motion on the platform and on the work deck of the platform. Additionally, the subterranean well that is drilled will have a riser extending from the sea floor to the platform. In other words, a riser extends from the sea floor to the floating platform. As will be understood by those of ordinary skill in the art, the riser generally does not move in unison with the platform since the riser is fixed to the sea floor by different attachment means and the riser does not experience the same buoyant forces as the floating platform.

As those of ordinary skill in the art will recognize, there is little unused work space on these offshore drilling rigs. In fact, working space is a premium while working in these remote location. While an operator is in the midst of performing well work, it may be necessary to rig-up certain equipment. For example, a coiled tubing unit may need to be rigged-up to run a string of tools into the well. Normal derrick space may be inadequate, and therefore, operators have used a lift frame in order to aid in rigging-up this type of equipment. These prior art lift frames provide a lifting structure for this equipment as well as providing a working window. However, prior art lift frames suffer from several problems including extreme difficulty in maneuvering and rigging-up equipment. In other words, the prior art designs of lift frames make it very difficult to rig-up and rig-down equipment. Thus, there is a need for a system and method that will provide maneuverability so that an operator can rig-up and rig-down well intervention equipment. There is also a need for a system that will allow for the flexibility required for rig-up and rig-down procedures. This invention solves these needs as will be evident from a reading of the disclosure.

SUMMARY OF THE INVENTION

An apparatus for performing well intervention work with a tubular on a rig is disclosed. The apparatus comprises a first spreader member that is operatively connected to a derrick, a pair of I-beams that have a distal end and a proximal end, and wherein the distal end of the pair of I-beams are connected to the first spreader member. The apparatus further comprises a second spreader member, and wherein the proximal end of the I-beams are connected to the second spreader member, and wherein the first spreader member and the second spreader member form a window working area. The apparatus further comprises a first pivot point on the first spreader member and a second pivot point on the second spreader member.

In the most preferred embodiment, the apparatus further comprises a door means, operatively attached to the second spreader member, for allowing entry of the tubular. Also, the apparatus may include a plurality of pivot points on the first spreader member and a plurality of pivot points on the second spreader member. Also in the most preferred embodiment, the door means may comprise a sliding sleeve, a hydraulic piston operatively connected to the sliding sleeve, and control means, operatively associated with the hydraulic piston, for actuating the hydraulic piston to open and close the sliding sleeve. Also, the door means may include a shoulder for engagement with the tubular so that the tubular is supported by the second spreader member so that the weight of the tubular can be transferred to the second spreader member and in turn to the apparatus.

The apparatus may further comprise a winch mounted on the first spreader member and positioned within the window. Also, the apparatus may include a walkway means, operatively attached to the first and second spreader member, for allowing a walkway about the apparatus.

A method of lifting a tubular during well intervention work on a rig is also disclosed. The rig contains a derrick and the rig is operatively connected to a well. The method comprises providing an apparatus, wherein the apparatus comprises: a first spreader member that is operatively connected to the derrick; a pair of I-beam members, with the I-beam members having a distal end and a proximal end, and wherein the distal end of the I-beam members are connected to the first spreader member; a second spreader member, and wherein the proximal end of the I-beam members are connected to the second spreader member, and wherein the first spreader member and the second spreader member forms a working window area; a first pivot point at the distal end of the channel member and a second pivot point at the proximal end of the channel member.

The method further comprises rigging up equipment, such as a coiled tubing injector head or BOP, within the work window, suspending the equipment within the working window area via a hoist, and opening the door. The method may further comprise placing the tubular through the opened door, closing the door, and resting a shoulder of the tubular on the door means. The method may further include transferring the weight of the tubular to a shoulder of the second spreader member, and lifting the tubular with the assembly.

The method may further include lowering the tubular with the assembly, disconnecting the tubular from the equipment, opening the door, and withdrawing the tubular through the opened door. In one preferred embodiment, the step of opening the door and the step of closing the door is performed utilizing a hydraulic pressure control means.

An advantage of the present invention is that the assembly forms a work window. Another advantage is that the assembly can be used with wireline, coiled tubing, or snubbing strings. Yet another advantage is that the assembly forms a vertical frame in the derrick, but can also be laid horizontally on the deck. Still yet another advantage is that the assembly can more easily handle tools during rig-up and rig-down than prior art tools due to the dual articulation from the top pivot point and the lower pivot point.

A feature of the present invention is the door in lower spreader. The door can be hydraulically or pneumatically operated for opening and closing, and wherein when the door is opened tubular members can be placed therein, and when closed, the door will capture the tubular therein. Another feature is that the door can be automatically controlled from a distance. Still yet another feature is that when the door is closed, the weight of the equipment can be transferred to the second spreader member and in turn to the assembly. Another feature is that the spreader member can act as an elevator for lifting and lowering tubulars and equipment.

Still yet another feature is that the bails in the most preferred can be an I-beam iron segment. Yet another feature is that the bails can be simply shortened or lengthened which in turn allows for either a shorter work window or a longer work window. Another feature is that most parts are interchangeable, and therefore, it is possible to assemble various size assemblies without having to manufacture all the various parts.

DETAILED DESCRIPTION OF THE PREFERRED EMBODIMENTS

Figure 1:
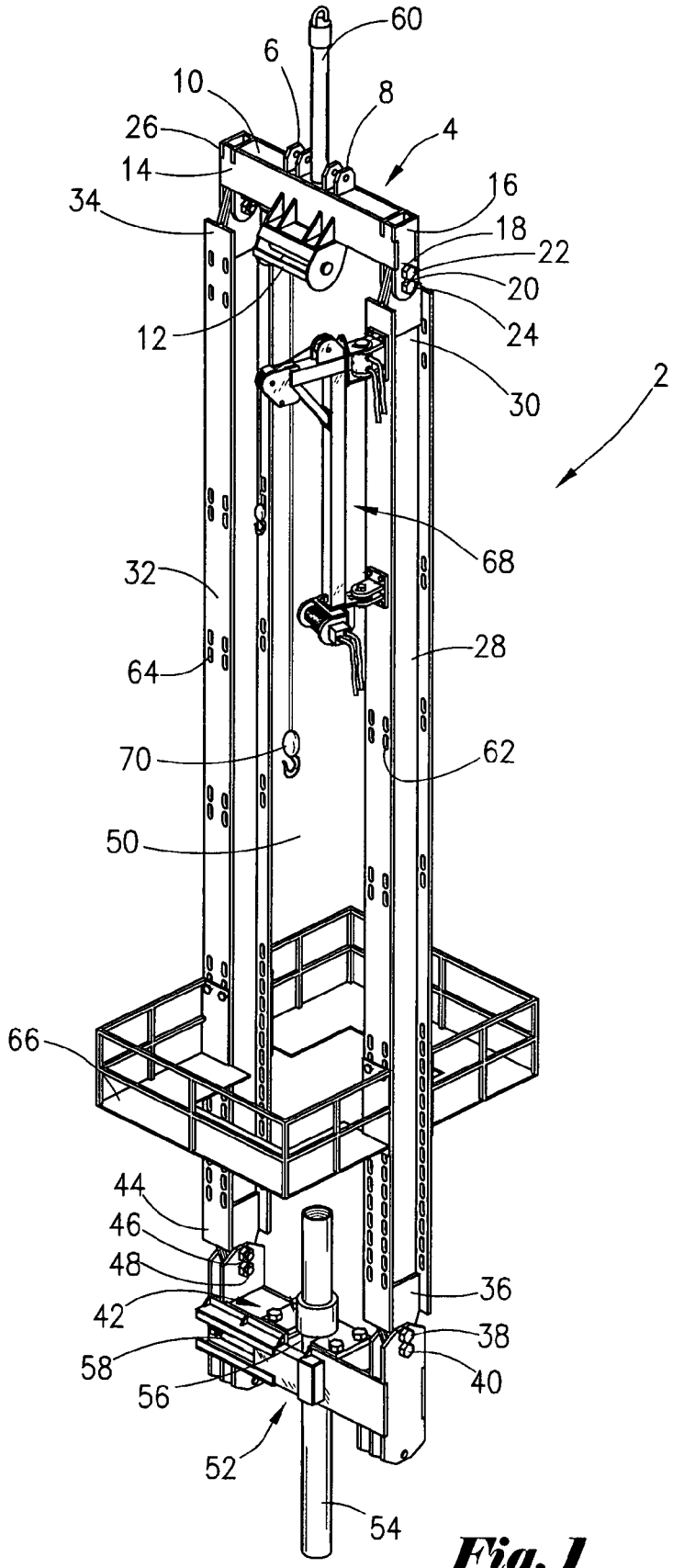
FIG. 1 is a perspective view of the most preferred embodiment of the articulating bail assembly.

Referring now to FIG. 1, a perspective view of the most preferred embodiment of the articulating bail assembly 2 will now be described. The assembly 2 includes a spreader member 4 (sometimes referred to as the upper spreader member) that is generally a rectangular box structure, and wherein the spreader member 4 contains a first pad-eye means 6 and second pad-eye means 8 disposed through the top side 10 and attached to the spreader 4. Additionally, the spreader member 4 will have a winch means 12 for winch objects, and wherein the winch means is attached to the side 14. Also, the spreader member 4 has another side 16, and wherein side 16 contains the apertures 18, 20 that will have disposed therein pins 22, 24. The pins 22, 24 will server as pins for pivoting as will be more fully explained later in the application. On an opposite side of 16 is side 26, and wherein side 26 will have a pair of apertures that contains a pair of pins (not seen in this view).

As seen in FIG. 1, an I-beam segment 28 (sometimes referred to as a bail 28) extends from the spreader member 4. More specifically, the I-beam segment 28 contains a proximal end 30 that contains a pair of apertures that will cooperate and align with the apertures 18, 20 so that the pins 22, 24 can be disposed there through. In this way, the channel bar segment 28 is pivotally attached to the spreader member 4 by taking out either the top pins or the lower pins. FIG. 1 further depicts the I-beam segment 32 (sometimes referred to as a bail), and wherein the I-beam segment 32 contains a proximal end 34 that contains a pair of apertures that will cooperate and align with apertures on side 26. The I-beam segments 28, 32 may be referred to as the pair of bails 28, 32.

The I-beam segment 28 has the distal end 36, and wherein the distal end 36 will have apertures therein for placement of pins 38, 40 for connection to the spreader member 42 (sometimes referred to as the lower spreader member 42). The I-beam segment 32 has the distal end 44, and wherein the distal end 44 will have apertures therein for placement of pins 46, 48 for connection to the spreader member 42. The spreader members 4 and 42, connected via channel bar segments 28, 32, define a working window area 50.

As shown in FIG. 1, the spreader member 42 can be pivoted relative to the I-beam segments 28, 32 by removing one set of pins i.e. removing pins 40, 48, and keeping in pins 38, 46. In this way, the operator can perform necessary rig-up and/or rig-down procedures which due to space and size limitations require manipulation of the various members. As noted earlier, according to the teachings of the present invention, the operator may also pivot the I-beam segments 28, 32 relative to the spreader member 4, and wherein this pivoting can be accomplished by removing either the upper pins or the lower pins.

FIG. 1 further depicts the door means, operatively attached to the spreader member 42, for selectively opening a door means 52 (sometimes referred to as the sleeve 52). As readily understood by those of ordinary skill in the art, in the course of performing well intervention work, an operator may find it necessary to allow entry of various equipment, including a tubular 54. The tubular 54 may be part of a down hole work string, and wherein the work string may be attached to a bottom hole assembly, as well understood by those of ordinary skill in the art. Hence, the operator would selectively open the door means 52, place the tubular 54 within the cavity 56, and then close the door means 52. In the most preferred embodiment, the door means 52 includes hydraulic piston 58. Note that cavity 56 is cylindrical in shape so that the tubular 54 is captured within the cavity 56 when the door is closed. Additionally, when the door 52 is closed, the spreader member 42 can act as an elevator for lifting and lowering tubulars and equipment, as will be more fully described later in the application.

Figure 2:
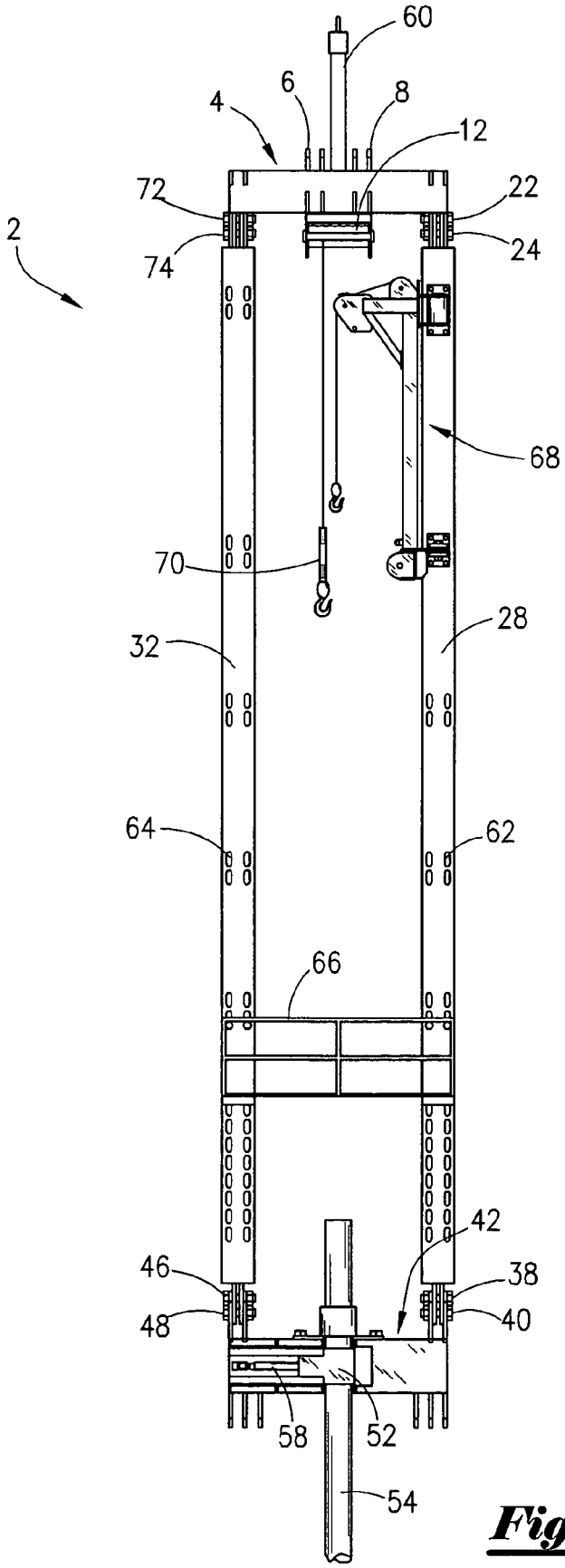
FIG. 2 is a front view of the articulating bail assembly seen in FIG. 1.

As shown in FIG. 1, a lift sub 60 is provided. As those of ordinary skill in the art will recognize, the lift sub 60 is connected to the spreader member 4 at one end and then will be connected, in the preferred embodiment, to a block in a derrick, which will be described in greater detail later in the application. FIG. 1 further depicts the slots 62, 64 in the I-beam segments 28, 32. A walkway, such as seen at 66, can be cantilevered with the slots so that roustabouts can have a working space about the working window area 50. FIG. 2 further depicts the swing arm crane 68 and wherein the swing arm crane 68 was described in the patent application entitled "Swing Arm Crane and Method", bearing Ser. No. 10/788,148, and filed on 26 Feb. 2004, and is incorporated herein by express reference. A hoist member 70 having a cable connected to the winch means 12 is also shown.

Referring now to FIG. 2, a front view of the dual articulating bail assembly 2 seen in FIG. 1 will now be described. It should be noted that like numbers appearing in the various figures refer to like components. FIG. 2 depicts the spreader member 4 having the I-beam segments 28, 32 extending therefrom, and wherein the pins 22, 24 and the pins 72, 74 are disposed through apertures in the spreader member 4 so that the I-beam segments 28, 32 can be pivoted relative to the spreader member 4 as previously noted.

As per the teachings of this invention, when both sets of pins are disposed within the apertures, the I-beam segments 28, 32 are rigidly held in position. In order to pivot, either the top pins (22, 72) or the bottom pins (24, 74) would have to be removed. FIG. 2 further depicts the pivotly connected spreader member 42, and wherein the pins 38, 40 disposed through apertures, and pins 46, 48 disposed through apertures, and wherein with the pins 38, 40, 46, 48 in place, the spreader member 42 is held rigidly in position. In order to pivot, either the top pins (38, 46) or the bottom pins (40, 48) must be removed. Thus, as per the teachings of the present invention, the assembly 2 provides dual pivot points, namely pivot points at the spreader member 4 and at the spreader member 42. A first pivot point in the spreader member 4 is formed via removable pins 72, 22. A second pivot point in the spreader member 4 is formed via removable pins 74, 24. A first pivot point in the spreader member 42 is formed via removable pins 46, 38. A second pivot point in the spreader 42 is formed via removable pins 48, 40.

FIG. 2 also shows the door means 52 in the closed position, and wherein the piston 58 is capable of selectively moving the door means 52 open and closed thereby capturing the tubular (or equipment). The weight of the equipment can be transferred to the spreader member. As noted earlier, when the door means 52 is closed, the top side of spreader member 42 can act as an elevator so that the equipment can be raised and/or lowered as desired by the operator.

Figure 3:
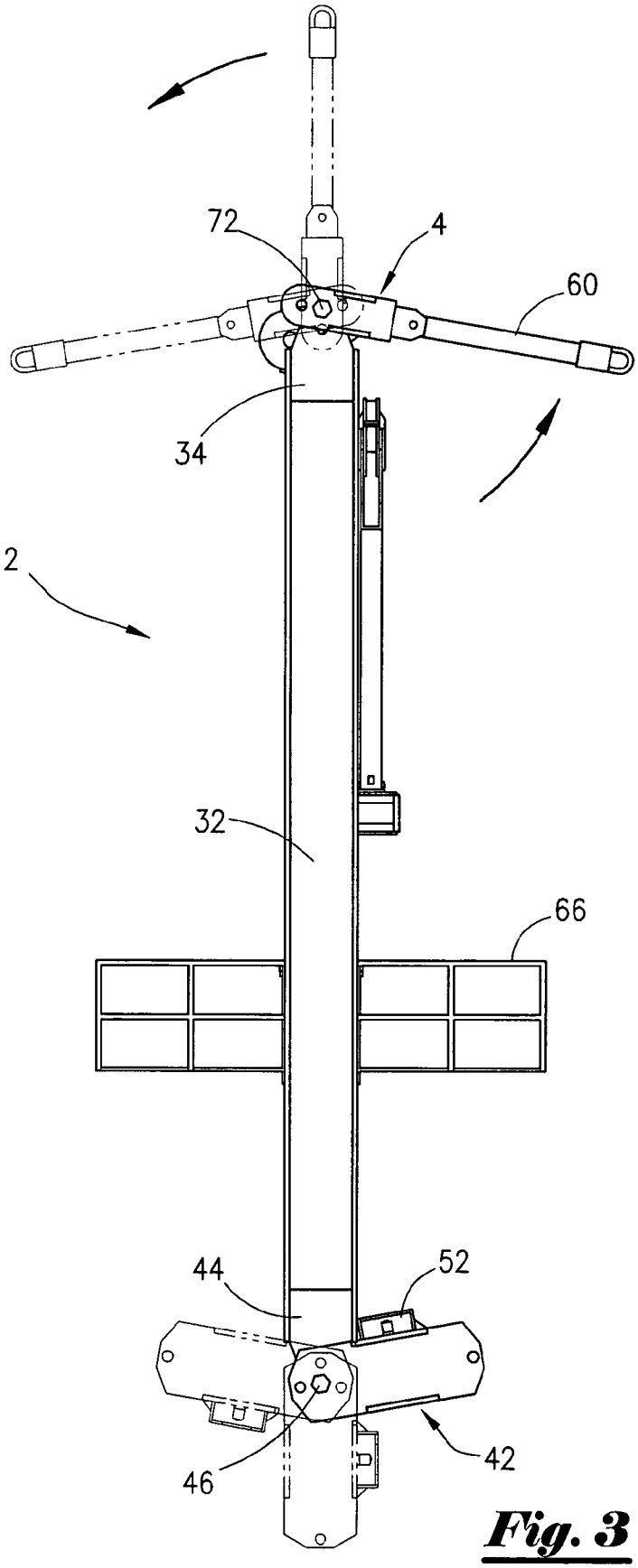
FIG. 3 is a side view of the articulating bail assembly seen in FIG. 2, wherein the assembly is shown pivoted at the proximal end and the distal end.

Referring now to FIG. 3, a side view of the dual articulating bail assembly 2 seen in FIG. 2 is illustrated, and wherein the assembly 2 is shown pivoted at the proximal end 34 and the distal end 44. As shown, the spreader member 4 has been pivoted at pin 72 (as well as pin 22, but not shown in this view); the spreader member 42 has been pivoted at pin 46 (as well as pin 38, but not shown in this view). The dual articulation shown in FIG. 3 allows the operator greater work area flexibility in rig-up and rig-down procedures.

Figure 4:
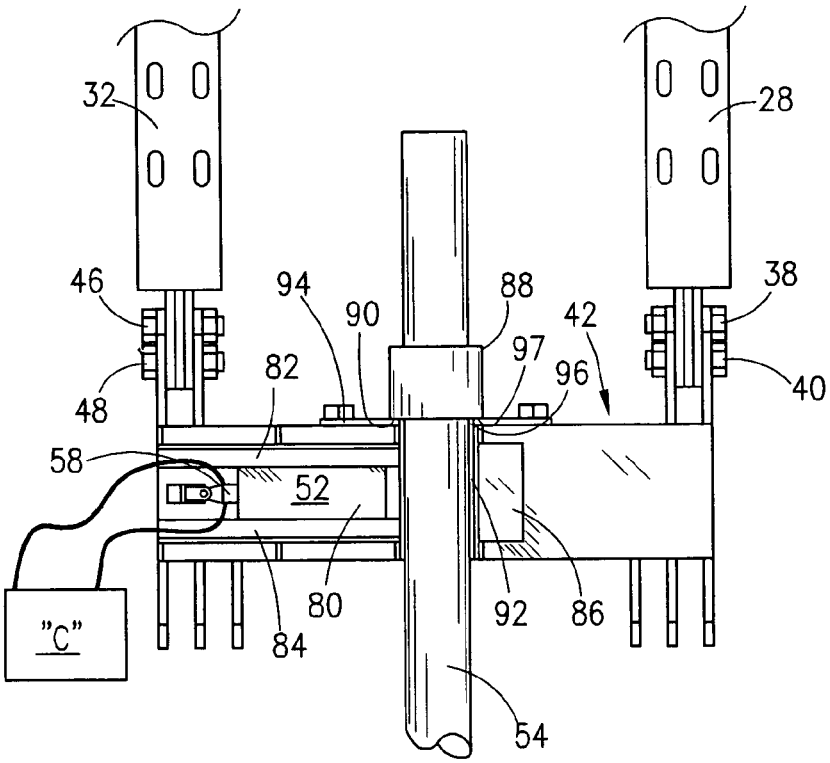
FIG. 4 is a close-up view of the spreader member with door, and wherein the door is in the open position.

FIG. 4 is a close-up view of the spreader member 42 with door means 52, and wherein the door means 52 is in the open position. More specifically, the I-beam segments 28, 32 are shown attached at the distal end to the spreader member 42. FIG. 4 shows the pins 38, 40 disposed through the apertures in I-beam segment 28 and the pins 46, 48 disposed through the apertures in I-beam segment 32.

The door means 52 comprises a sliding sleeve in the shape of a rectangle sleeve 80. The door means 52 further includes tracks 82, 84 that cooperate with the rectangle sleeve 80. The door means 52 further includes the cover member 86 that will cover and shield the door means 52 once the door means 52 is in the closed position. FIG. 4 further depicts the piston 58 and wherein the piston 58 is a hydraulically controlled piston that has a first end attached to the spreader member 42 and a second end attached to the sleeve 80. Thus, as hydraulic pressure is applied to the piston cylinder, the piston 58 will extend thereby moving the sleeve 80 to the closed position. FIG. 4 depicts the control means "C", wherein the control means "C" is a hydraulically controlled valve device for selectively delivering hydraulic pressure to the piston 58. The control means "C" may include a hydraulic valve, hydraulic reservoir, and hydraulic pump. The control means "C" is commercially available from Hydradyne Corporation under the name DV-20. It should be noted that a pneumatic means or an electrical means could also be used to move the piston 58. Additionally, it is also possible to manually open and close the sleeve 80. In the most preferred embodiment, the hydraulic piston 58 with the hydraulic control means "C" for supplying hydraulic fluid input and output to the hydraulic piston 58 for activation will be utilized.

FIG. 4 also shows that the tubular 54 has an area of expanded outer diameter 88 that extends to the shoulder 90. As noted earlier, the spreader 42 contains a cavity for placement of the tubular 54 (seen generally at 92). On the top side of the spreader member 42 is the plate 94 that contains the opening 96. The plate 94 contains the shoulder 97. As shown in FIG. 4, the shoulder 90 rest on the plate 94, and in particular, on shoulder 97. In this way, the spreader member 42 has become an elevator capable of lifting and/or lowering the tubular 54. Additionally, the plate 94, with a different size opening, can be easily changed for a different size opening so that other outer diameter sized members can be hung off on the spreader member 42. In other words, the size of the opening 96 can be varied in order to accommodate different size equipment, and an operator can simply change out plates and wherein each plate contains different size openings.

Figure 5:
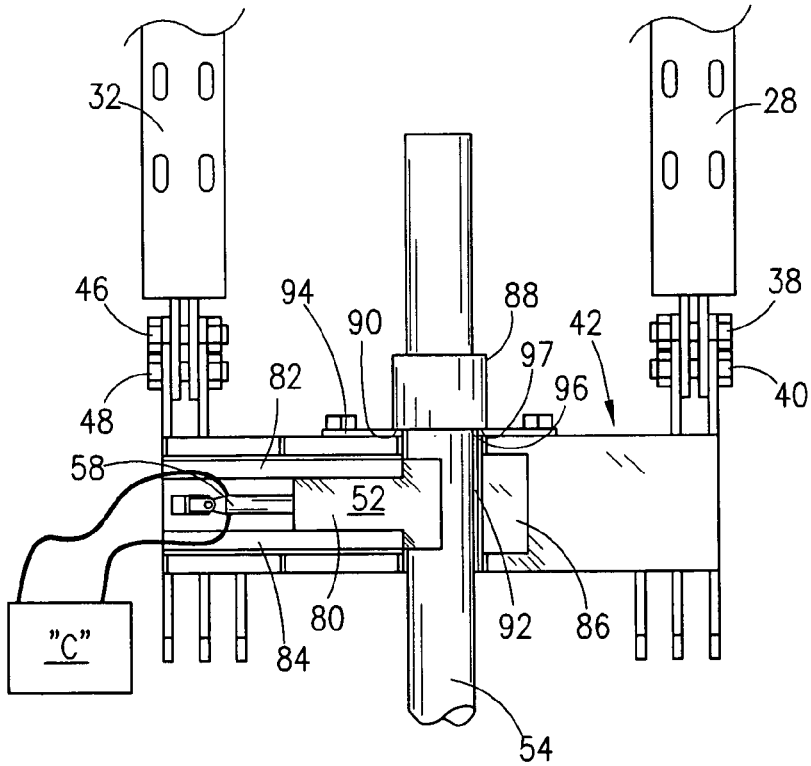
FIG. 5 is the spreader member with door seen in FIG. 4, and wherein the door is in the intermediate position.
Figure 6:
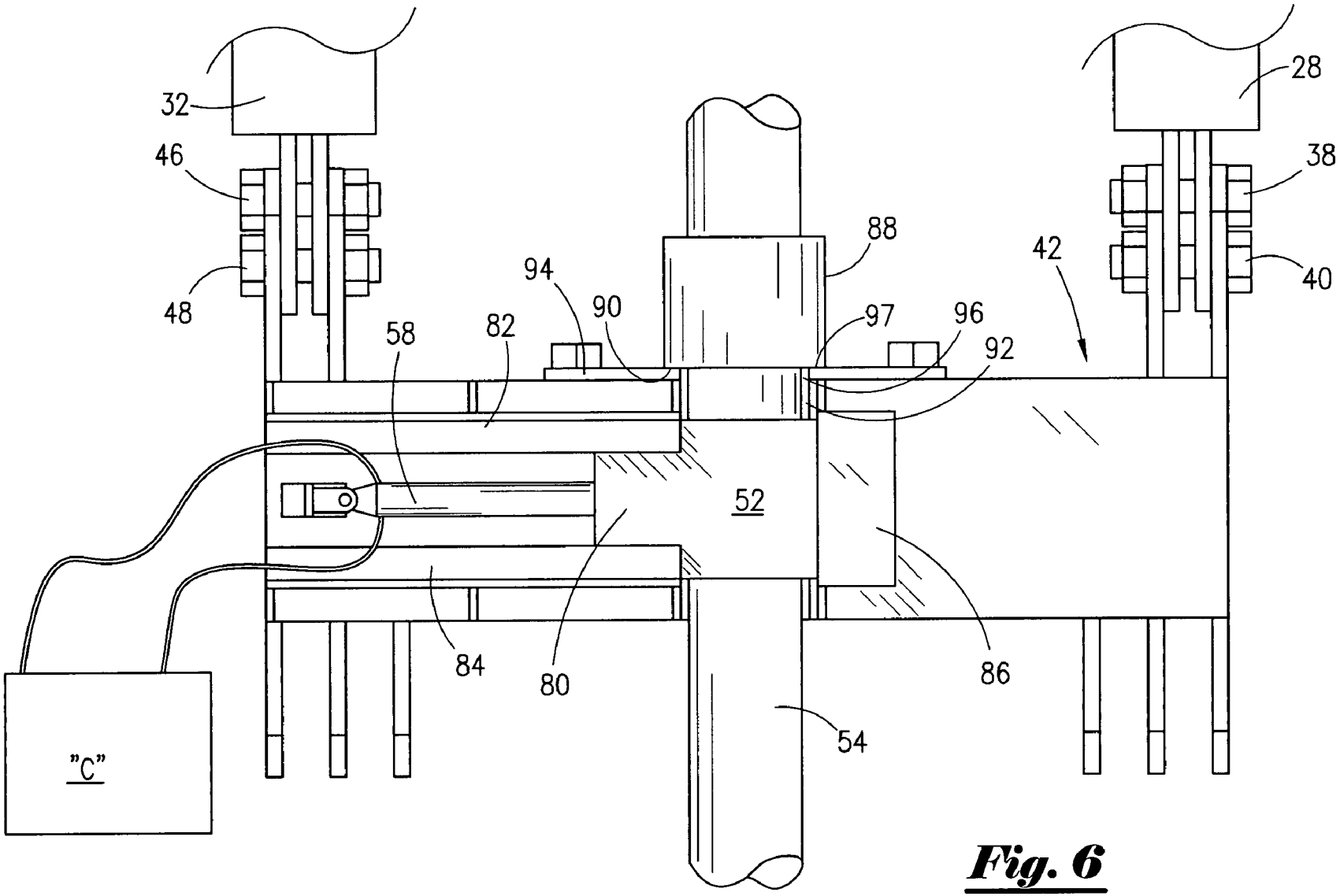
FIG. 6 is the spreader member with door seen in FIG. 4, and wherein the door is in the closed position.

Referring now to FIG. 5, the spreader member 42 with the sleeve 80 seen in FIG. 4 is shown, and wherein the door means 52 is in the intermediate closed position. The door means 52 has been moved via the hydraulic piston 58, and wherein the sleeve 80 is being moved along the tracks 82, 84. In the next sequential view seen in expanded FIG. 6, the sleeve 80 is now in the closed position. Hence, the sleeve 80 has been moved so that a portion of the sleeve 80 fits under the cover member 86. As shown in FIG. 6, the door means 52 is closed and the tubular member 54 is held in place and captured. Moreover, the shoulder 90 rest on the shoulder 97 of plate 94 and the spreader member 42 acts as an elevator. Essentially, the shoulder 97 of plate 94 acts to transfer weight from the tubular member 54 to the spreader member 42. More specifically, the spreader member 42 can raise and lower the tubular 54.

It should be noted that it is possible to have the cavity 92 shaped in a wedge profile so that the tubular member can be inserted within the cavity 92, and wherein a shoulder on the tubular would not be required. In such a case, a slip member (not shown), which is well known in the art, would be used in cooperation with the opening 96 and the profile of cavity 92 to fit into the cavity 92 i.e. the slip member is configured to fit within the profile of cavity 92.

Figure 7:
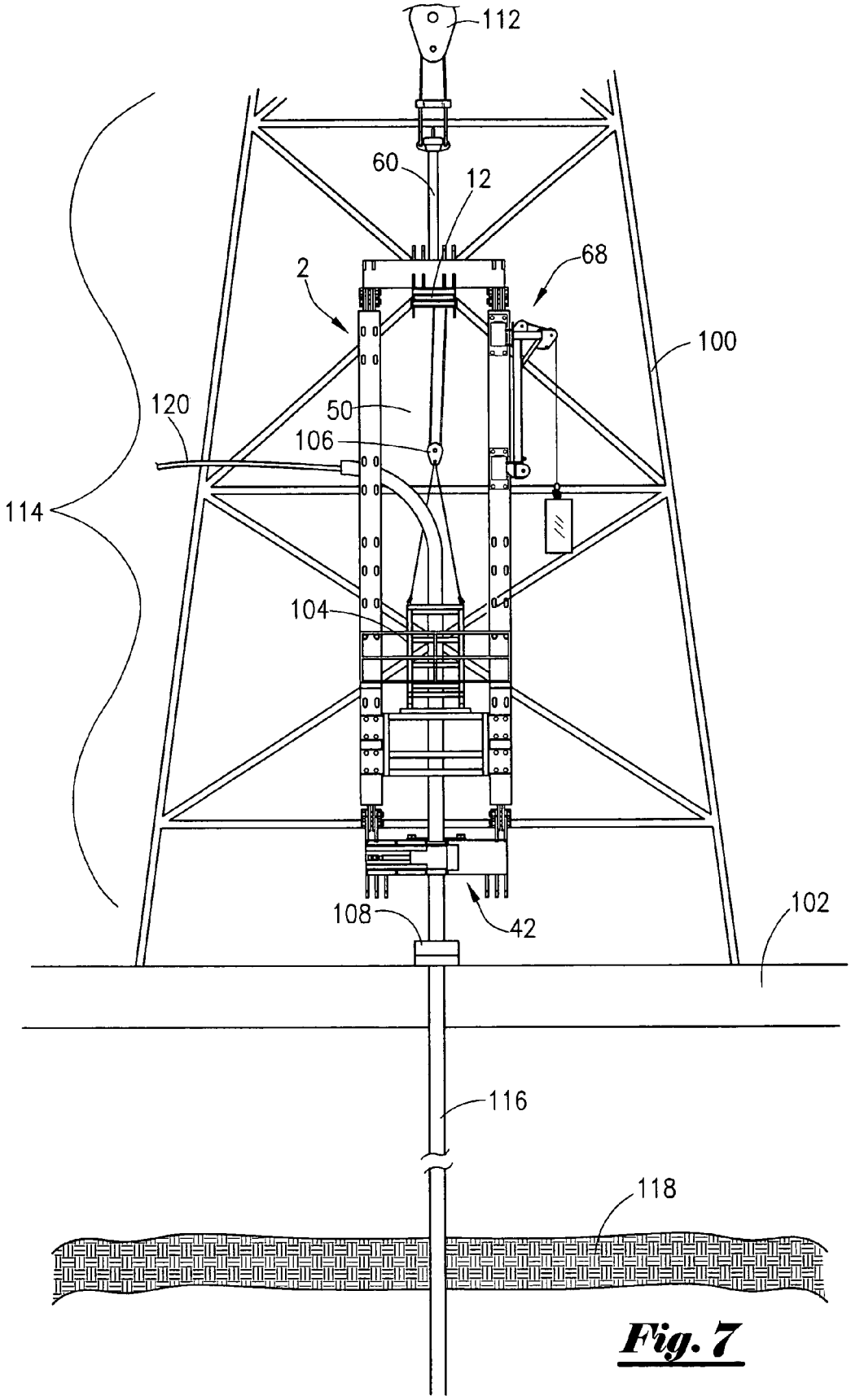
FIG. 7 is a schematic view of the articulating bail assembly seen suspended in a derrick of an offshore rig.

Referring now to FIG. 7, a schematic view of the articulating bail assembly 2 suspended in a derrick 100 of an offshore rig 102 will now be described. A coiled tubing injector head 104 has been rigged-up within the working window area 50. The coiled tubing injector head 104 is commercially available from Hydra Rig Corporation under the name Coiled Tubing Injector Head. The winch means 12 has a hoist 106 operatively associated therewith and wherein the hoist 106 is operatively attached to the coiled tubing injector head 104. The swing arm crane 68 has been moved to a position exterior of the working window area 50. The coiled tubing injector head 104 is rigged up to the well head, seen generally at 108. The surface work string and assembly connected at one end to the well head 108 and at the opposite end to the block 112 is collectively referred to as the well intervention string assembly 114.

The well head 108 connects to a subterranean well 116 that intersects a hydrocarbon bearing reservoir 118. In the position seen in FIG. 7, the operator can use the assembly 2 to aid in rigging-up, or rigging-down, by lifting supplemental equipment required during operations, such as rigging-up or rigging-down BOPs, lubricators, down hole tools, assemblies, etc., as noted earlier. The assembly 2 can be used before being hung in the derrick i.e. in a horizontal position, and wherein the articulation (e.g. pivoting) of the I-beam can be performed. Also, the assembly 2 can be used as an elevator for lifting and lowering equipment. Once the head 104 is rigged-up, the operator can run into the well with coiled tubing 120 and perform the necessary well work, as is readily understood by those of ordinary skill in the art. After the well work, the assembly 2 can be used to rig-down the equipment.

Changes and modifications in the specifically described embodiments can be carried out without departing from the scope of the invention which is intended to be limited only by the scope of the appended claims and any equivalents thereof.

We claim:

1. An apparatus for performing well intervention work with a tubular on a rig, wherein the rig has a derrick positioned thereon, the apparatus comprising:

a first spreader member, said first spreader member being operatively connected to the derrick;

a pair of bails, said pair of bails having a distal end and a proximal end, and wherein the distal end of said pair of bails is connected to the first spreader member and wherein the pair of bails are I-beam members;

a second spreader member, and wherein said proximal end of said pair of bails is connected to the second spreader member, and wherein said second spreader member contains a passage for the tubular;

a door means, operatively attached to said second spreader member, for allowing entry of the tubular through the passage and wherein said door means contains a shoulder for engagement with the tubular so that the tubular is supported by the second spreader member;

a plurality of pivot points on the first spreader member.

2. The apparatus of claim 1 further comprising: a plurality of pivot points on the second spreader member.

3. The apparatus of claim 2 wherein said door means comprises:

a sliding sleeve;

a hydraulic piston operatively connected to said sliding sleeve, control means, operatively associated with said hydraulic piston, for actuating the hydraulic piston to open and close the sliding sleeve-ding sleeve.

4. The apparatus of claim 2 further comprising:

a winch mounted on the first spreader member;

a walkway means, operatively attached to said pair of bails, for allowing a walkway about the apparatus.

5. An apparatus for performing well intervention work with a tubular on an offshore rig, wherein the rig has a derrick positioned thereon, the apparatus comprising:

a first spreader member, said first spreader member being operatively connected to the derrick;

a pair of I-beam members, said I-beam members having a distal end and a proximal end, and wherein the distal end of said I-beam members are connected to the first spreader member;

a second spreader member, and wherein said proximal end of said I-beam members are connected to the second spreader member, and wherein said first spreader member and said second spreader member form a working window area;

a first pivot point on the first spreader member;

a second pivot point on the second spreader member;

a door means, operatively attached to said second spreader member, for allowing entry of the tubular and capturing the tubular;

a shoulder, located on said second spreader member, for engagement with the tubular so that the tubular is supported by the second spreader member;

a third pivot point on the first spreader member.

6. The apparatus of claim 5 further comprising: a fourth pivot point on the second spreader member.

7. The apparatus of claim 6 wherein said door means comprises:

a sliding sleeve;

a hydraulic piston operatively connected to said sliding sleeve;

control means, operatively associated with said hydraulic piston, for actuating the hydraulic piston to open and close the sliding sleeve.

8. The apparatus of claim 6 further comprising:

a winch mounted on said first spreader member and positioned within the window working area.

9. The apparatus of claim 8 further comprising:

a walkway means, operatively attached to said pair of I-beam members, for allowing a walkway about the apparatus.

10. An apparatus for use within a derrick of an offshore rig, the apparatus comprising:

a first spreader member, said first spreader member being operatively connected to the derrick;

a pair of I-beam members, said pair of I-beam members having a distal end and a proximal end, and wherein the distal end of said pair of I-beam members is connected to the first spreader member;

a second spreader member, and wherein said proximal end of said pair of I-beam members is connected to the second spreader member, and wherein said second spreader member containing a passage for the tubular, and wherein said first spreader member and said second spreader member forming a window;

a first pivot point on the first spreader member;

a second pivot point on the first spreader member;

a third pivot point on the second spreader member;

a fourth pivot point on the second spreader member;

a sliding sleeve slidably attached to said second spreader member.

11. The apparatus of claim 10 further comprising:

a plate having an opening, said plate being connected to said second spreader member and wherein said opening is configured to engage a tubular placed within said opening in order to transfer the weight of the tubular to the second spreader member.

12. The apparatus of claim 11 further comprising:

a hydraulic piston operatively connected to said sliding sleeve;

control means, operatively associated with said hydraulic piston, for actuating the hydraulic piston to open and close the sliding sleeve.

* * * * *